US007962085B2

(12) United States Patent
Thayer et al.

(10) Patent No.: US 7,962,085 B2
(45) Date of Patent: Jun. 14, 2011

(54) METAL BLADE CLEANING OF AN AMORPHOUS SILICON RECEPTOR

(75) Inventors: Bruce E. Thayer, Spencerport, NY (US); John F. Knapp, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 12/579,853

(22) Filed: Oct. 15, 2009

(65) Prior Publication Data

US 2011/0091255 A1 Apr. 21, 2011

(51) Int. Cl.
*G03G 21/00* (2006.01)

(52) U.S. Cl. ..... 399/350

(58) Field of Classification Search ..... 399/350; 15/256.5, 256.51, 256.52
See application file for complete search history.

(56) References Cited

U.S. PATENT DOCUMENTS

| | | | | |
|---|---|---|---|---|
| 4,785,324 | A | 11/1988 | Yamazaki et al. | |
| 4,889,782 | A | 12/1989 | Yamazaki | |
| 4,970,560 | A * | 11/1990 | Lindblad et al. | 399/350 |
| 5,640,663 | A | 6/1997 | Hirai et al. | |
| 6,226,479 | B1 | 5/2001 | Karaki et al. | |
| 6,233,417 | B1 | 5/2001 | Nakayama et al. | |
| 6,453,137 | B2 | 9/2002 | Iinuma | |
| 6,633,739 | B2 * | 10/2003 | White et al. | 399/350 X |
| 6,686,109 | B2 | 2/2004 | Matsuoka et al. | |
| 7,127,201 | B2 * | 10/2006 | Takenouchi et al. | 399/350 X |
| 2006/0216085 | A1 * | 9/2006 | Murakami et al. | 399/350 |

FOREIGN PATENT DOCUMENTS

| | | | |
|---|---|---|---|
| JP | 62-254174 A | * | 11/1987 |
| JP | 06-027860 A | * | 2/1994 |

* cited by examiner

*Primary Examiner* — Sophia S Chen
(74) *Attorney, Agent, or Firm* — Ronald E. Prass, Jr.; Prass LLP

(57) ABSTRACT

This is a shim cleaning blade for use in a novel cleaning station of an electrophotographic marking system having an a-Si photoconductive surface. The cleaning blade is preferably made from stainless steel but other metals can be used if suitable. The blade has a thickness of about 0.05-0.2 mm, but best results are obtained when using a thickness of about 005-0.1 mm. The cleaning blade contacts the photoconductive surface it is cleaning at an angle of from about 2 to about 40 degrees.

18 Claims, 3 Drawing Sheets

METAL BLADE CLEANING OF AN AMORPHOUS SILICON RECEPTOR

This invention relates to xerographic marking systems and, more specifically, to blades used in cleaning stations of said systems.

BACKGROUND

The present invention for clarity will be described in relation to its use on xerographic drums or belts; however, the use of this blade in or on other photoconductive surfaces such as endless belts, plates or other photosensitive surfaces of a xerographic system are intended to be included, if suitable.

In marking systems such as Xerography or other electrostatographic processes, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attached to the latent electrostatic image areas creates a visible replica of the original. The developed image is then usually transferred from the photoreceptor surface to a final support material, such as paper, and the toner image is usually fixed by fusing thereto to form a permanent record corresponding to the original.

In some Xerographic marking systems, a photoreceptor surface is generally arranged to move in an endless path through the various processing stations of the xerographic process. Since the photoreceptor surface is reusable, the toner image is then transferred to a final support material, such as paper, and the surface of the photoreceptor is prepared to be cleaned and used once again for the reproduction of a copy of an original. In this endless path, several Xerographic related stations are traversed by the photoconductive drum or belt.

Generally, in one embodiment, after the transfer station, a photoconductor cleaning station is next and it generally comprises a cleaning brush and a blade or a cleaning blade alone which is used to remove residual debris from the drum or belt such as toner, toner additives and other filming materials. This film is generally caused by the residual toner being impacted onto the drum or belt by the cleaning brushes and/or blades. When the lubrication of this blade is below a necessary level, it will abrade the belt. Toner is the primary lubricant for the blade; however, a problem is with good cleaning efficiency by the cleaning brushes, the amount of toner reaching the blade can often be well below this necessary level. Without proper lubrication, or if the blade is composed of the wrong material, this blade can seriously abrade the belt.

Since most toners used today are negatively charged, the embodiments throughout this disclosure and claims will be described relating to the use of a negative toner; however, when a positive toner is used, the proper opposite adjustments can easily be made.

The brush above mentioned in prior art systems is responsible for nearly all of the filming on the photoconductive (PC) belt or drum. This brush is positively charged to attract a negative charged toner and remove most of it from the PC belt or drum. Adjacent to the first brush is a vacuum which vacuums the toner from the brush for later disposal. The vacuum is adjacent to the brush and should vacuum off of the brush some residual positively charged toner. Then, as above noted, the cleaning blade scrapes off the belt any remaining toner debris or film layer. If suitable, the cleaning blade can be used in a xerographic system without the brush or brushes. As above noted, the cleaning blade will remove the film layer comprised of toner and toner additives that may be caused by the impact of the cleaning brush against the toner and PC drum or belt.

Many of the low volume electrophotographic printers and some high speed marking apparatus comprising amorphous silicon photoreceptors (a-Si) use elastic polyurethane blades to remove residual toner from drum or belt. Improvements in the reliability of such blades are desired to minimize/reduce wear induced defects and to extend the overall life of the cleaning blade and the drum or belt. Polyurethane and other elastomeric materials are typically used in prior art cleaning blade materials. Improved blade materials are required on a-Si photoconductive surfaces to extend the useful life of both the blades and the a-Si photoconductive surface.

The use of prior art polyurethane cleaning blades with amorphous silicon photoreceptive surfaces are described in U.S. Pat. Nos. 6,226,479; 6,453,137; and 6,233,417.

Amorphous silicon (a-Si) photoreceptors have very hard, long wearing surfaces. The hardness of the surface enables long photoreceptor life, but due to the low wear rate films and oxidation can build-up on the photoreceptor surface. The conventional urethane blade cleaner for a-Si photoreceptors do not sufficiently abrade the surface of the photoreceptor to eliminate the films and oxidation. This leads to the need for a buffing of the photoreceptor surface by a service technician to remove the films and oxidation. More recently abrasive particles have been added to the toner to increase wear of the photoreceptor by the cleaning blade. Abrasive toner additives sometimes have eliminated the need for photoreceptor buffing. Since abrasive toner additives increase blade wear as well as photoreceptor wear, the life of the cleaning blade is substantially reduced. Amorphous silicon photoreceptors are advertised to have lives up to 5 Mp, but the polyurethane cleaning blades with them typically last to 20% or less of the photoreceptor life.

SUMMARY

The present invention provides using a preferred thickness of 0.05-0.1 mm stainless steel cleaning blade to clean hard amorphous silicon P/R drums. Other blade thicknesses up to 0.2 mm will function, however not as effectively as the 0.05-0.1 mm blades. As earlier noted, the a-Si surface is very hard, and has an advertised life of 5 Mp, but urethane blades can allow the build-up of films and oxidation on the surface. This is now managed by buffing by a service technician or by adding an abrasive to the toner. However, the abrasives reduce the life of the cleaning blade. Thin steel blades would have adequate conformability for the smooth drum surface and can remove films. Steel blades have worked very well in cleaning smooth, hard anodized detone rolls in several Xerox products. Other metals such as beryllium copper or phosphor bronze will also work as the blades of this invention. Metal blades have several other advantages over polyurethane blades: to allow more liberal tolerance due to wider cleaning latitude, not sensitive to environment, no set with age, won't flip and long wear life. The preferred steel blade edge is hard and sharp enough to remove films, and steel blades will last much longer than prior art urethane.

A metal shim blade is provided for use on an amorphous silicon photoreceptor but may be used with other photoreceptors if suitable. The preferable blade thickness, 0.05-0.1 mm in stainless steel, would provide sufficient conformability to the a-Si photoreceptor drum for good cleaning without excessive blade set-up tolerances. The metal blade would supply sufficient wear of the a-Si surface to eliminate the need for manual buffing or abrasive toner additives thereby reducing service and toner costs. The use of stainless steel metal shim blades could match or exceed the expected life of a-Si photoreceptor drums. The blade of this invention is not affected by temperature, wears more uniformly, has longer life and is more reliable than the urethane blades of the prior art.

DETAILED DISCUSSION OF DRAWINGS AND PREFERRED EMBODIMENTS

Figure 1:
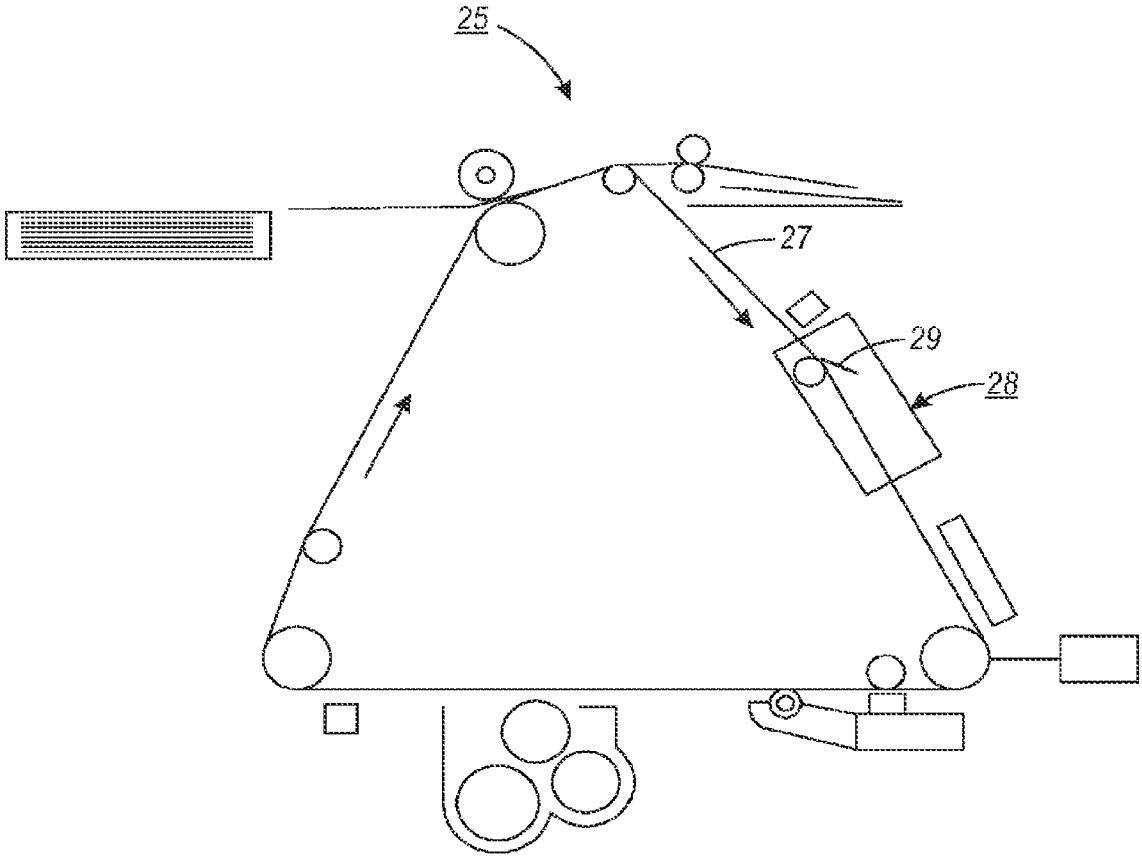
FIG. 1 is a schematic view of a xerographic marking system using the cleaning blade of the present invention in its cleaning station.

In FIG. 1, a schematic of a xerographic marking system 25 where a a-Si photosensitive belt 27 is used is shown; however a photosensitive drum with the same xerographic stations can be equally used. The cleaning blade of the invention is used in cleaning station 28 as shown in drum cleaning of FIG. 2. The components of xerographic marking system include a sensor to determine toner residual on surface 27, a stacking assembly, a collection station, paper, paper feed, a charging station, an exposure station, a developer station, a fusing station, a motor, rollers, a xerographic system, a transfer station, an amorphous silicon photoconductor belt (or drum with same stations, and a cleaning station.

Figure 2:
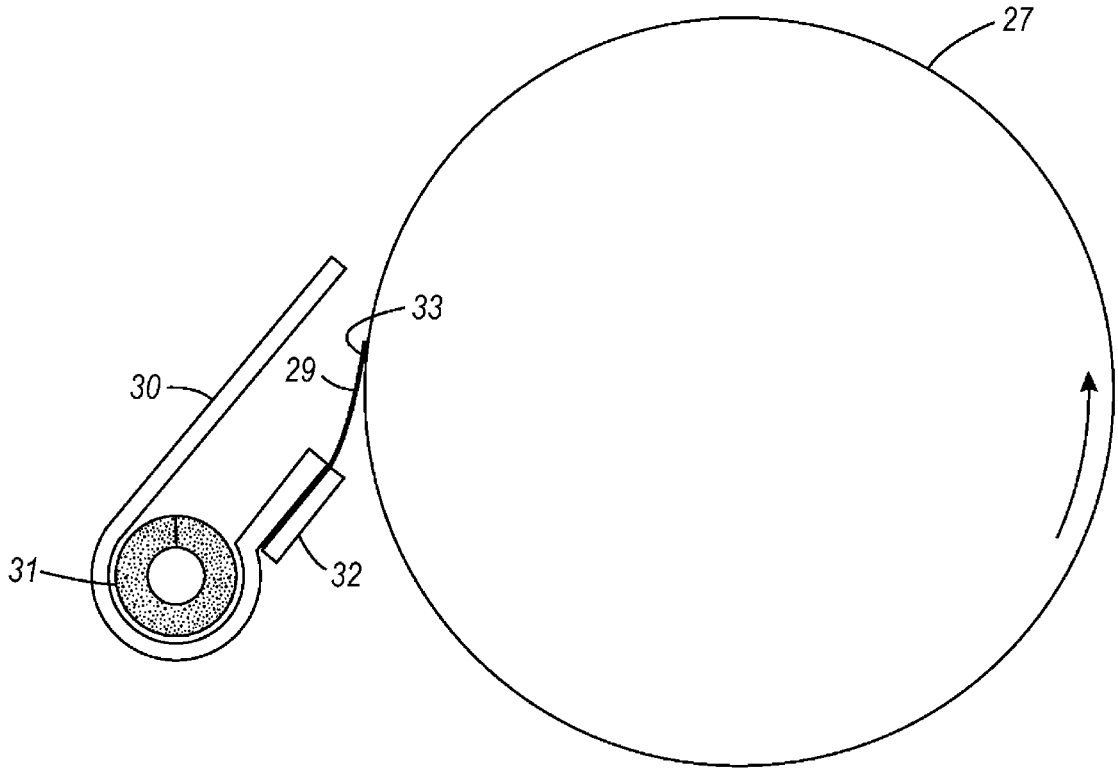
FIG. 2 is a schematic view of the metal shim blade of this invention cleaning an amorphous silicon photoreceptor surface of a xerographic drum.

FIG. 2 is a schematic view of a metal shim blade 29 cleaning an amorphous silicon a-Si photoreceptor 27. Toner is removed by the metal shim operating in the doctor mode. Cleaned toner is contained and directed by the cleaner housing 30 into the waste toner auger 31 located below the cleaning blade holder 32. The cleaning blade 29 is supported in a blade holder 32 that is straight and rigid enough to provide a uniform blade load against the photoreceptor surface 27 from the inboard to the outboard end of the blade 29. Features (not shown) in the blade and blade holder locate the blade in the holder so that the extension of the blade from the holder is uniform along the length of the blade 29. The blade clamp 32 holds the blade 29 uniformly against the blade holder 32.

For good cleaning the tip 33 of the blade 29 must be free of burrs and ideally it is ground and lapped to provide a square, sharp, uniform edge to ride against the photoreceptor surface 27. As the blade 29 wears, it conforms to the shape of the photoreceptor surface 27. Since photoreceptors are manufactured to have very low runout and a smooth surface, the blade edge 33 will wear uniformly if it is loaded uniformly.

Figure 3:
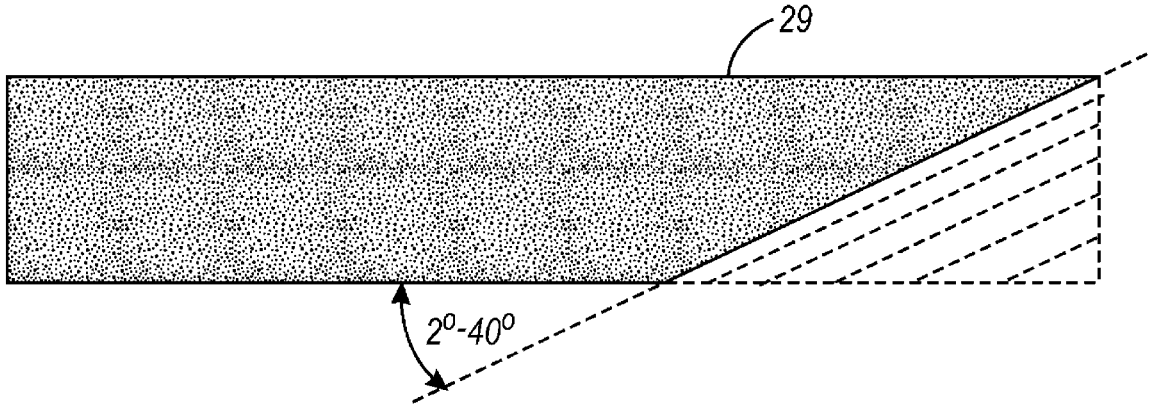
FIG. 3 is a plan view illustrating the life cycle of a metal cleaning blade of this invention.

Blade life can be determined by the number of photoreceptor cycles required to wear through the thickness of the metal shim blade 29 (see FIG. 3). Blade failure or life is defined when thickness of the blade 29 has been worn through as shown in FIG. 3. For uniformly loaded blades with fairly consistent lubrication, the blade 29 wear rate is uniform and predictable. This results in a consistently predictable blade life and high reliability. The failure definition shown in FIG. 3 is conservative, however, since there have been many occurrences of blades 29 wearing well past the original blade length with no loss of cleaning function. If the angle of the blade tip 33 to the photoreceptor 27 is too sharp, then the blade 29 may fail to clean when it has worn through or nearly through the blade thickness. A preferred angle of the tip of blade 29 to the photoreceptor 27 is about 15 degrees. When the blade angle is too sharp and worn to a point, there is very little pressure on the tip 33 of the blade against the photoreceptor 27. A low pressure allows toner to pass under the blade and creates a cleaning failure.

In FIG. 3, metal shim blades 29 of this invention have the same critical parameters, i.e., blade load, working angle and material properties, as prior art urethane cleaning blades. The material properties for metal shim blades 29 are much less complicated than for non-linear elastomers. Blade loads for metal blades 29 of this invention do not decrease over time due to stress relaxation as they do for urethane blades. The friction coefficient for a metal blade sliding across the photoreceptor 27 is lower than the friction coefficient for urethane rubber. Metal blade properties do not change with environmental conditions for the range of machine operating temperatures and relative humidities. Metal shim blades 29 of this invention can operate at blade loads and working angles similar to those for urethane cleaning blades, but they have wider latitudes for these parameters than urethane cleaning blades.

The obvious choice of the preferred material for the metal shim cleaning blade 29 is stainless steel since there is good experience with this material on detoning rolls. Stainless steel is a good choice because of its non-corrosion properties. Early detoning blades were made of Starrett shim stock, a specialty high carbon steel without the non-corrosion properties of stainless steel. These blades worked well for cleaning, but tended to form light surface rust, especially from fingerprints. These early blades were replaced with stainless steel primarily for aesthetic reasons. As noted above, a variety of metals are of interest as cleaning blades 29 and may be used if suitable in place of the preferred stainless steel. These include stainless steels, high carbon steels, phosphor bronze, beryllium, copper, full hard yellow brass and other copper and steel alloys. The choice of material will depend on suitability, cost, wear rate and availability. Since the cleaning blade is a thin strip requiring only a small amount of material, choice of metal alloy will not appreciably impact the final cost of the part. The wear rate is a function of the frictional properties of the chosen material and the material hardness. Due to work hardening induced while rolling the material to its desired thickness, the true hardness of the material will be difficult to measure on such a thin strip. The best way to determine wear rates is through measurements of actual blades against a-Si drums or belt.

Metal shim cleaning blades 29 provide a number of advantages over prior art urethane cleaning blades for a-Si photoreceptor drums. Unlike urethane blades, metal shim blades 29 have environmental and time dependent stability that makes blade design easier and does not require tight tolerances to operate within the cleaning latitude. Cleaning latitudes are wider and due to lower friction blade flip is not the problem it is for urethane blades. Metal shim blades wear at low, consistent rates providing long life and high reliability. Wear of the a-Si photoreceptor surface by a metal cleaning blade provides the opportunity to eliminate service cost for drum buffing and reduce toner cost by eliminating abrasive toner additives. Metal shim blades for cleaning a-Si photoreceptors is a valuable invention.

It is critical to the present invention that the metal shim blades conform to the photoconductive or photosensitive surface 27. Stainless steel blades exceeding 0.2 mm thickness will be too stiff to properly conform to the photoconductive or photosensitive surface 27. If the 0.2 mm stainless steel blade thickness is exceeded the blade will not properly clean the surface 27 and also may scratch the surface 27. A stainless steel blade thickness of 0.05-0.1 mm is highly preferred and will work best when used as described herein. The preferred blade thickness for other blade materials is found by multiplying the stainless steel blade thickness by the cube root of the ratio of the thickness by the cube root of the ratio of the stainless steel elastic modulus (Young's modulus) over the other material elastic modulus. FIG. 3 shows a blade worn to the state where it would be replaced. The dashed lines indicate various stages of blade wear at roughly equal time intervals. The dashed lines become progressively closer together because as the blade wears, the contact area to the photoreceptor increases, and the pressure decreases. These blades 29 have a long life and can function with a large amount of wear.

A contact angle of the blade 29 to the photoconductive or photosensitive surface 27 is also critical; an angle of 2 to 40 degrees will function, but about 15 degrees is preferred for best results and for best useful life. Stainless steel is the preferred blade material because of its proven effective use in detoning rolls used in the xerographic system. Acceptable blade contact for detoning is however substantially different than the contact of the shim blade of this invention with delicate photoconductive surfaces. Scratching and scraping of a detoning roll surface does not lead to print quality defects, but is a serious concern with a photoconductive surface. Appropriate choices of blade thickness, contact angle, extension, material and load are required to prevent the blade from scratching and gouging the photoreceptor surface. The values of these parameters are best chosen following testing with the a-Si photoreceptor and toner used in the application. The frictional characteristics of the a-Si photoreceptor surface and the toner will influence the optimal design for the metal shim blade.

To summarize, the present invention provides a novel xerographic marking system with a novel cleaning station of the system. The xerographic marking system comprises an amorphous silicon (a-Si) photoconductive surface extending through a cleaning station, which surface is configured to pass through the cleaning station after imaging and containing residual toner. The cleaning station comprises a-Si photoconductive surface (PR) and a metallic shim cleaning blade in contact with the PR surface. This metallic shim cleaning blade is comprised of a material selected from the group consisting of steel, beryllium copper, phosphor bronze and alloys thereof. The metallic shim cleaning blade has a thickness up to about 0.2 mm, and for best results preferably has a thickness of about 0.05 to 0.1 mm. The metallic shim cleaning blade is configured to contact the photoconductive surface at an angle of from 2 to about 40 degrees (preferred is about 15 degrees), and is preferably made from stainless steel. The metallic shim cleaning blade has a useful life in the marking system of at least equal to the useful life of the a-Si photoconductive surface. The metallic shim cleaning blade has a useful life of at least 5 million xerographic image passes and has a sharp blade edge that is configured to continuously remove films from the a-Si photoreceptor surface. This blade edge can have the same or different metal composition as the remainder of the shim cleaning blade. The metallic shim cleaning blade is not sensitive to adverse environmental conditions in the cleaning station.

The novel cleaning station of the electrophotographic marking system comprises an amorphous a-Si photoconductive surface and a metallic shim cleaning blade configured to remove films, excess or residual toner and toner additives from the photoconductive surface. The metallic shim cleaning blade has a thickness up to about 0.2 mm and comprises a material selected from the group consisting of steel, beryllium copper, phosphor bronze and alloys thereof.

The highly preferred embodiment of the metallic shim cleaning blade has a thickness of from about 0.05 to about 0.1 mm and is preferably made from stainless steel, and has a useful life of at least 5 million imaging passes. The metal shim cleaning blade has a sharp blade edge that is configured to continuously remove films from the a-Si photoreceptor surface. This blade edge is comprised of a material selected from the group consisting of steel, beryllium copper, phosphor bronze and alloys thereof. Its edge can be made from the same or different metal than the remainder of the blade.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A xerographic marking system comprising:

an amorphous silicon (a-Si) photoconductive surface, and a cleaning station, said photoconductive surface configured to pass through said cleaning station, said cleaning station comprising said a-Si photoconductive surface (PR) and a metallic shim cleaning blade in contact with said PR surface, said metallic shim cleaning blade comprising a material selected from the group consisting of steel, beryllium copper, phosphor bronze or alloys thereof, said metallic shim cleaning blade having a thickness up to about 0.2 mm and a useful life of at least 5 million image passes.

2. The marking system of claim 1 wherein said metallic shim cleaning blade has a thickness of about 0.05-0.1 mm.

3. The marking system of claim 1 wherein said metallic shim cleaning blade is configured to contact said photoconductive surface at an angle of from 2 to about 40 degrees.

4. The marking system of claim 1 wherein said metallic shim cleaning blade is made from stainless steel.

5. The marking system of claim 1 wherein said metallic shim cleaning blade has a useful life in said marking system at least equal to the useful life of said photoconductive surface.

6. The marking system of claim 1 wherein said metal shim cleaning blade has a sharp blade edge that is configured to continuously remove films from said a-Si photoconductive surface.

7. The marking system of claim 1 wherein said metallic shim cleaning blade is not sensitive to adverse environmental conditions.

8. A cleaning station of an electrophotographic marking system, said station comprising:

an amorphous (a-Si) photoconductive surface and a metallic shim cleaning blade configured to remove films, excess or residual toner and toner additives from said photoconductive surface, said metallic shim cleaning blade having a thickness up to about 0.2 mm and a useful life of at least 5 million image passes, and said metallic shim cleaning blade comprising a material selected from the group consisting of steel, beryllium copper, phosphor bronze, and alloys thereof.

9. The station of claim 8 wherein said metallic shim cleaning blade has a thickness of from about 0.05-0.1 mm.

10. The station of claim 8 wherein said metallic shim cleaning blade contacts said photoconductive surface at an angle of from 2 to about 40 degrees.

11. The station of claim 8 wherein said metallic shim cleaning blade is made from stainless steel, and the angle of blade to photoconductive surface is about 15 degrees.

12. The station of claim 8 wherein said metal shim cleaning blade has a sharp blade edge that is configured to continuously remove films from said a-Si photoconductive surface, said blade edge comprising a material selected from the group consisting of steel, beryllium copper, phosphor bronze and alloys thereof.

13. The station of claim 8 wherein said metal shim cleaning blade is resistant to adverse environmental conditions in said cleaning station.

14. The station of claim 8 wherein said photoconductive surface is a drum photoconductive surface.

15. The station of claim 8 where said photoconductive surface is a belt photoconductive surface.

16. A method of cleaning a photoreceptor surface in an electrophotographic marking system, said method comprising:

providing a cleaning station in said marking system, passing a photoreceptor surface through said cleaning station, said photoreceptor surface comprising an amorphous Silicon (a-Si) photoconductor, positioning a metallic shim cleaning blade in contact with said photoreceptor surface, said blade comprising a material selected from the group consisting of steel, beryllium copper, phosphor bronze and alloys thereof, said metallic shim cleaning blade having a thickness up to about 0.2 mm and a useful life of at least 5 million image passes.

17. The method of claim 16 wherein said shim cleaning blade has a thickness of about 0.05-0.1 mm.

18. The method of claim 16 wherein said metallic shim cleaning blade is made of stainless steel and is put in contact with said photoreceptor surface at an angle of from about 2-15 degrees.

* * * * *